US008858077B2

(12) United States Patent
Shepard

(10) Patent No.: US 8,858,077 B2
(45) Date of Patent: Oct. 14, 2014

(54) RECLOSABLE POUCH CLOSURES AND RELATED PACKAGING AND METHODS

(75) Inventor: William H. Shepard, Amherst, NH (US)

(73) Assignee: Velcro Industries B.V., Willemstad (CW)

( * ) Notice: Subject to any disclaimer, the term of this patent is extended or adjusted under 35 U.S.C. 154(b) by 572 days.

(21) Appl. No.: 13/078,232

(22) Filed: Apr. 1, 2011

(65) Prior Publication Data

US 2011/0249919 A1 Oct. 13, 2011

Related U.S. Application Data

(60) Provisional application No. 61/323,103, filed on Apr. 12, 2010.

(51) Int. Cl.

| | |
|---|---|
| ***B65D 33/16*** | (2006.01) |
| ***B65D 75/00*** | (2006.01) |
| ***B65D 33/24*** | (2006.01) |
| ***B65D 30/20*** | (2006.01) |
| ***B65D 75/58*** | (2006.01) |

(52) U.S. Cl.

CPC ..... *B65D 33/24* (2013.01); *B65D 75/008* (2013.01); *B65D 2313/02* (2013.01); *B65D 31/10* (2013.01); *B65D 75/5866* (2013.01)

USPC ..... 383/63; 383/203; 383/42; 383/5

(58) Field of Classification Search

USPC ..... 383/42, 63, 203, 5, 61.2, 61.3, 64, 65

See application file for complete search history.

(56) References Cited

U.S. PATENT DOCUMENTS

| | | | |
|---|---|---|---|
| 3,372,438 | A | 3/1968 | Rinecker |
| 3,417,440 | A | 12/1968 | Billarant |

(Continued)

FOREIGN PATENT DOCUMENTS

| | | |
|---|---|---|
| DE | 20302093 | 7/2003 |
| DE | 20 2008 008134 | 6/2009 |
| EP | 2 067 710 | 6/2009 |

OTHER PUBLICATIONS

International Search Report and Written Opinion; PCT/US2011;030908; mailed May 30, 2011.

(Continued)

*Primary Examiner* — Jes F Pascua
*Assistant Examiner* — Peter Helvey
(74) *Attorney, Agent, or Firm* — Fish & Richardson P.C.

(57) ABSTRACT

A reclosable package that includes a pouch of flexible material that includes a reclosable closure secured to the flexible material adjacent an opening to releasably retain the opening of the pouch in a closed state. The closure includes fastenable closure strips that extend along opposite sides of the opening and that are releasably fastenable in multiple relative positions spaced along each of two perpendicular directions. The closure and flexible material of the pouch are configured to provide a maximum stiffness, in resistance to bending about a pouch axis extending along the pouch perpendicular to the closure strips, as determined at a point along the closure with the closure strips fastened, that is more than 10 times the maximum stiffness, in resistance to bending about the pouch axis, of one of the closure strips as secured to the flexible material, as determined at the point along the closure with the closure strips unfastened.

17 Claims, 16 Drawing Sheets

(56) References Cited

U.S. PATENT DOCUMENTS

| | | | | |
|---|---|---|---|---|
| 3,446,420 | A | 5/1969 | Rinecker | |
| 3,464,094 | A | 9/1969 | Mates | |
| 3,557,853 | A | 1/1971 | Jones | |
| 3,594,865 | A | 7/1971 | Erb | |
| 3,655,118 | A | 4/1972 | Rinecker | |
| 3,696,472 | A | 10/1972 | Perina et al. | |
| 3,727,829 | A | 4/1973 | Huni | |
| 3,780,781 | A | 12/1973 | Uramoto | |
| 3,807,626 | A | 4/1974 | Goodrich | |
| 4,241,865 | A | 12/1980 | Ferrell | |
| 4,337,889 | A | 7/1982 | Moertel | |
| 4,567,987 | A | 2/1986 | Lepisto et al. | |
| 4,580,683 | A | 4/1986 | Gochenour | |
| 4,620,320 | A | 10/1986 | Sullivan | |
| 4,637,063 | A | 1/1987 | Sullivan et al. | |
| 4,672,722 | A | 6/1987 | Malamed | |
| 4,706,297 | A | 11/1987 | Ausnit | |
| 4,761,318 | A | 8/1988 | Ott et al. | |
| 4,794,028 | A | 12/1988 | Fischer | |
| 4,812,074 | A | 3/1989 | Ausnit et al. | |
| 4,824,261 | A | 4/1989 | Provost | |
| 4,854,017 | A * | 8/1989 | Kamp | 24/585.12 |
| 4,917,506 | A * | 4/1990 | Scheibner | 383/63 |
| 4,955,981 | A | 9/1990 | Provost | |
| 4,967,451 | A | 11/1990 | Boyn | |
| 5,024,537 | A | 6/1991 | Tilman | |
| 5,032,122 | A | 7/1991 | Noel et al. | |
| 5,088,164 | A | 2/1992 | Wilson et al. | |
| 5,113,555 | A | 5/1992 | Wilson et al. | |
| 5,116,140 | A | 5/1992 | Hirashima | |
| 5,140,727 | A * | 8/1992 | Dais et al. | 24/585.12 |
| 5,172,980 | A | 12/1992 | Provost | |
| 5,215,380 | A | 6/1993 | Custer et al. | |
| 5,260,015 | A | 11/1993 | Kennedy et al. | |
| 5,315,740 | A | 5/1994 | Provost | |
| 5,354,591 | A | 10/1994 | Ott et al. | |
| 5,360,270 | A | 11/1994 | Appeldorn et al. | |
| 5,369,847 | A | 12/1994 | Naya et al. | |
| 5,369,853 | A | 12/1994 | Okawa et al. | |
| 5,413,568 | A | 5/1995 | Roach et al. | |
| 5,461,845 | A | 10/1995 | Yeager | |
| 5,601,368 | A | 2/1997 | Bodolay et al. | |
| 5,611,791 | A | 3/1997 | Gorman et al. | |
| 5,620,769 | A | 4/1997 | Wessels et al. | |
| 5,669,120 | A | 9/1997 | Wessels et al. | |
| 5,699,593 | A | 12/1997 | Jackson | |
| 5,745,961 | A | 5/1998 | Okawa et al. | |
| 5,763,041 | A | 6/1998 | Leak et al. | |
| 5,773,120 | A | 6/1998 | Deka et al. | |
| 5,857,245 | A | 1/1999 | Sakakibara et al. | |
| 5,873,456 | A | 2/1999 | Hull et al. | |
| 5,887,320 | A | 3/1999 | Provost | |
| 5,964,399 | A | 10/1999 | Ruben | |
| 5,985,407 | A | 11/1999 | Murasaki | |
| 6,060,146 | A | 5/2000 | Akeno et al. | |
| 6,202,260 | B1 | 3/2001 | Clune et al. | |
| 6,205,623 | B1 | 3/2001 | Shepard et al. | |
| 6,235,369 | B1 | 5/2001 | Shepard et al. | |
| 6,376,128 | B1 | 4/2002 | Goto | |
| 6,481,063 | B2 | 11/2002 | Shepard et al. | |
| 6,656,403 | B1 | 12/2003 | Clune et al. | |
| 6,660,202 | B2 | 12/2003 | Shepard et al. | |
| 6,851,161 | B2 | 2/2005 | Kingsford et al. | |
| 6,991,375 | B2 | 1/2006 | Clune et al. | |
| 7,163,706 | B2 | 1/2007 | Shepard et al. | |
| 7,186,025 | B2 | 3/2007 | Shepard et al. | |
| 7,308,783 | B2 | 12/2007 | Shepard et al. | |
| 7,395,583 | B2 | 7/2008 | Clune et al. | |
| 7,406,810 | B2 | 8/2008 | Clune et al. | |
| 7,424,796 | B2 | 9/2008 | Shepard et al. | |
| 2004/0001927 | A1 | 1/2004 | Moran et al. | |
| 2005/0041894 | A1 * | 2/2005 | Hanson | 383/120 |
| 2005/0063617 | A1 * | 3/2005 | Tilman | 383/5 |
| 2006/0062496 | A1 | 3/2006 | Clune et al. | |
| 2006/0107501 | A1 * | 5/2006 | Tremblay et al. | 24/442 |
| 2007/0258663 | A1 * | 11/2007 | Plourde et al. | 383/9 |
| 2009/0010735 | A1 | 1/2009 | Gallant et al. | |
| 2011/0091140 | A1 | 4/2011 | Wedi et al. | |
| 2011/0249919 | A1 * | 10/2011 | Shepard | 383/203 |
| 2011/0268372 | A1 * | 11/2011 | Brauer et al. | 383/64 |
| 2011/0311167 | A1 * | 12/2011 | Hall | 383/61.2 |
| 2012/0106875 | A1 * | 5/2012 | Pawloski | 383/64 |

OTHER PUBLICATIONS

Notification of Transmittal of International Preliminary Report on Patentability; PCT/US2011/030908; mailed Jan. 3, 2012.

* cited by examiner

RECLOSABLE POUCH CLOSURES AND RELATED PACKAGING AND METHODS

CROSS-REFERENCE TO RELATED APPLICATIONS

This application claims the benefit of U.S. Provisional Application No. 61/323,103, filed on Apr. 12, 2010, which is incorporated by reference herein.

TECHNICAL FIELD

This invention relates to reclosable pouch closures, packaging containing such closures, and methods of constructing reclosable pouches.

BACKGROUND

Reclosable pouches or bags come in many forms. Some are sold empty, such as for storing leftover food and the like. Others are filled with bulk materials, such as pet foods, granular, liquid or powdered foods for human consumption, or other pourable materials. Even grated cheese products are now packaged in reclosable pouches.

Pouches or bags are typically fashioned from lightweight, flexible material, such as plastic film. The film is folded and joined to form a pouch or bag defining an interior space, and a reclosable fastener is provided at the opening, for holding the pouch closed after removal of some of the contents. Examples of such closures include the common rib-and-groove closures sometimes sold under then mark ZIP-LOC, and hook-and-loop closures sometimes sold under the mark VELCRO. Yet another type of refastenable strip-form closure that has had some use on pouches features mating arrays of discrete, interlocking stems or fastening elements.

Some flat pouches are constructed from a single sheet of plastic film folded at the end of the bag opposite the opening. Some pouches are constructed with side or bottom gussets that expand when the bag is filled. Some bag side gussets may be opened to form pour spouts. Some filled pouches are constructed to stand upright when filled, such as for display on a store shelf.

SUMMARY

Some aspects of the invention derive in part from an understanding that some refastenable bag closures can be fashioned to provide a significantly higher stiffness in the region of a bag opening when fastened, than when opened. In the open state, the pouch material forming the opening thereby has flexibility to permit easy access to pouch contents, while with the fastener closed, the region of the pouch adjacent the opening has a significant resistance to flexure and creasing. For pouches carrying graphics, such stiffness can help to present the graphics in a consistent, desirable manner. Such stiffness can also help to resist pouch corner sag on the shelf, or creasing during transport, maintaining a "new" look to the pouch.

In some aspects, the invention features a pouch with a closure configured, along with the flexible material of the pouch in the area of the closure, to have a maximum bending stiffness with the closure strips fastened, that is at least 10 times the maximum bending stiffness of one side of the closure with the pouch opened.

In one aspect, a reclosable package includes a pouch of flexible material defining an interior volume and an opening providing access to the interior volume, and a reclosable closure secured to the flexible material adjacent the opening and operable to releasably retain the opening of the pouch in a closed state after partial removal of contents from the interior volume. The closure includes fastenable closure strips extending along at least portions of opposite sides of the opening. The closure strips are releasably fastenable in multiple relative positions spaced along each of two perpendicular directions. The closure and flexible material of the pouch are configured to provide a maximum stiffness, in resistance to bending about a pouch axis extending along the pouch perpendicular to the closure strips, as determined at a point along the closure with the closure strips fastened, that is at least 10 times the maximum stiffness, in resistance to bending about the pouch axis, of one of the closure strips as secured to the flexible material, as determined at the point along the closure with the closure strips unfastened.

In some embodiments, the closure strips carry compatible arrays of discrete fastening projections, and the arrays feature multiple rows and multiple columns of fastening projections that are interengageable in multiple relative positions along each row and along each column. In some embodiments, each projection is in the form of a hook having a head that extends to a reentrant tip to form a crook. In some embodiments, the hooks of each strip extend from a flexible, unitary base, and the base and hooks of each strip form a single, contiguous mass of resin. In some embodiments, the head of each hook overhangs the base on a side opposite the tip of the head.

In some embodiments, the pouch defines a flexible face surface carrying graphics that overlie the closure.

In some embodiments, an edge region of the pouch adjacent the closure defines an aperture through the flexible material, on a side of the closure opposite the interior volume, by which aperture the pouch is supportable in a hanging position when filled, the closure stiffening an upper portion of the package when hung from the aperture.

In some embodiments, the pouch has a gusseted end spaced from the opening, such that the pouch is configured to be self-supporting in an upright position on the gusseted end when filled. In some embodiments, the opening is disposed at an upper end region of the pouch in its upright position In some embodiments, the opening encompasses a side gusset of the bag, and wherein the closure strips are portions of a single, unitary strip of self-engageable fastener tape that folds upon itself to retain the opening in its closed state, the unitary strip forms acute bends at edges of the side gusset when fastened, and the bends define flexure points at which the closure extends as gusset is opened to form a pour spout.

In some embodiments, the pouch of flexible material includes a front face panel that defines the opening, and one of the closure strips is attached to the front face panel above the opening and another of the closure strips is attached to the front face panel below the opening.

In some embodiments, the closure includes a base having a thinned tear region that connects a first of the closure strips to a second of the closure strips. In some embodiments, the thinned tear regions is configured to be manually torn so that the first and second closure strips can be separated from one another.

In some embodiments, the closure and flexible material of the pouch are configured to provide a maximum stiffness, in resistance to bending about the pouch axis, as determined at a point along the closure with the closure strips fastened, that is at least 15 times (e.g., at least 20 times) the maximum stiffness, in resistance to bending about the pouch axis, of one of the closure strips as secured to the flexible material, as determined at the point along the closure with the closure strips unfastened.

In some embodiments, the closure and flexible material of the pouch are configured to provide a maximum stiffness, in resistance to bending about the pouch axis, as determined at a point along the closure with the closure strips fastened, that is 10-30 times (e.g., 15-25 times) the maximum stiffness, in resistance to bending about the pouch axis, of one of the closure strips as secured to the flexible material, as determined at the point along the closure with the closure strips unfastened.

Other aspects, features, and advantages will be apparent from the description and drawings, and from the claims.

DETAILED DESCRIPTION

Figure 1:
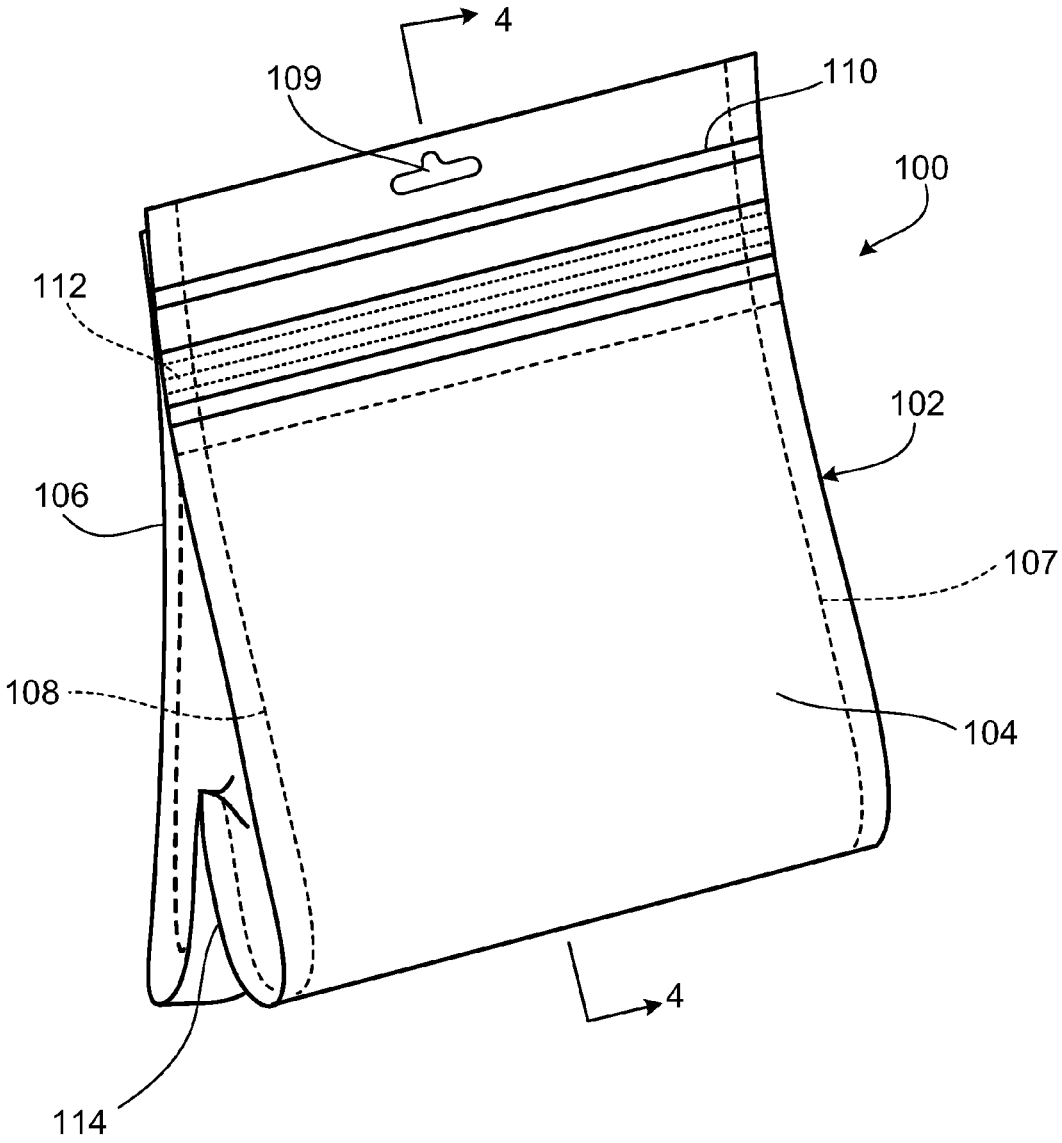
FIG. 1 is a perspective view of a gusseted bag including a self-engaging fastener closure welded between front and rear walls of the bag.
Figure 2:
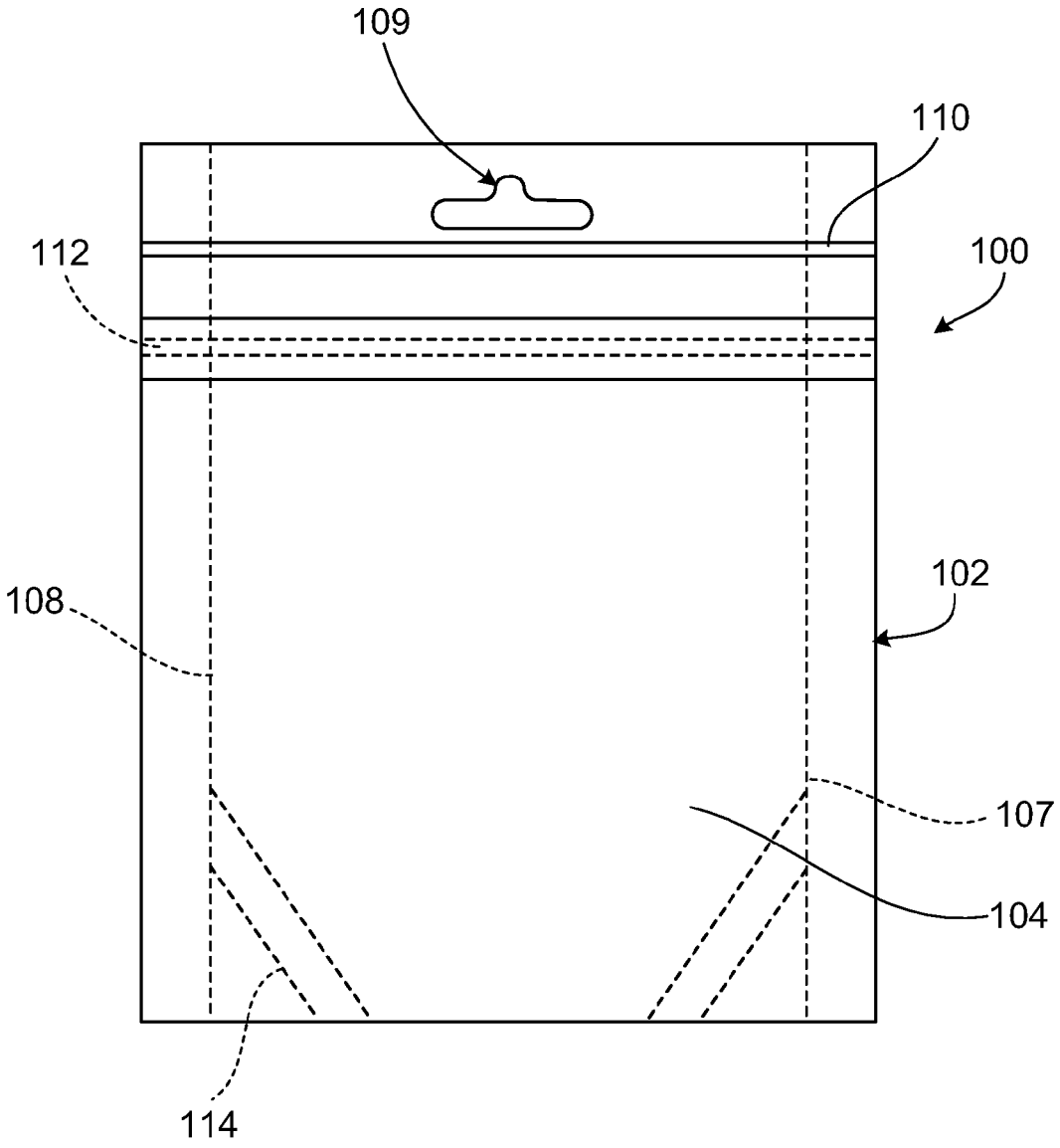
FIG. 2 is a front view of the bag of FIG. 1.
Figure 3:
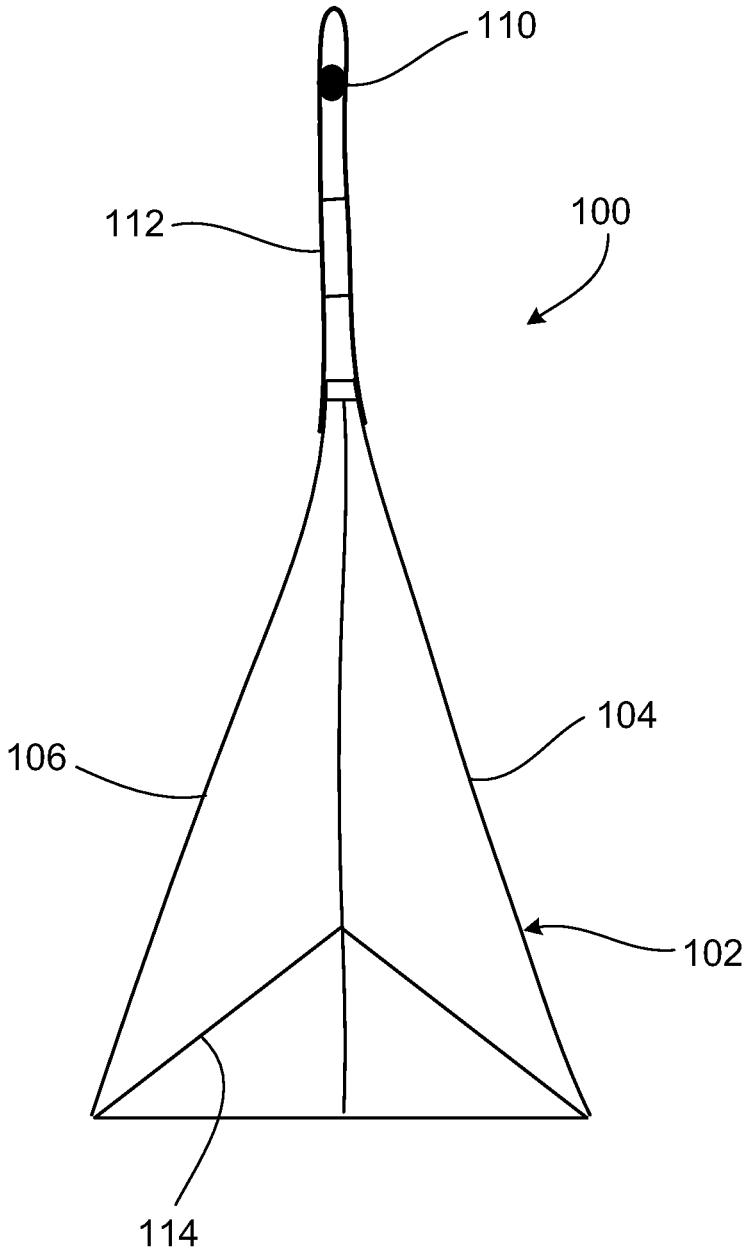
FIG. 3 is a side view of the bag of FIG. 1.

FIGS. 1-3 are perspective, front, and side views, respectively, of a disposable, reclosable bag 100 that is suitable for packaging bulk granular or powdered products, such as consumable foodstuffs, animal feed, fertilizers, cleaners and the like, for retail sale. Bag 100, as shown in FIGS. 1-3, includes a body 102 having a front face panel 104 and a rear face panel 106. Bag body 102 is formed of a single, folded sheet of polyethylene film sealed along side edge regions 107, 108. The folded sheet of film is also sealed along a top edge region 110. An aperture 109 is formed through front and rear face panels 104, 106 in an area above top seal 110 to allow bag 100 to be hung from a display rack.

A reclosable closure 112 is positioned between front and rear face panels 104, 106 in a top region of bag 100. As described below, closure 112 provides the portions of front and rear face panels 104, 106 adjacent closure 112 with sufficient stiffness to prevent those portions of the panels from becoming significantly deformed or distorted when closure 112 is engaged (i.e., when two halves or strips of closure 112 are releasably secured to one another). In addition, the engaged closure 112 helps to prevent the upper corner regions of bag 100 from flopping over or drooping and covering areas of front and rear face panels 104, 106, which may, in certain instances, have text or graphics printed thereon. The engaged closure 112 can, for example, help to prevent the top corner regions of bag 100 from flopping over or drooping when bag 400 is hung from a display rack using aperture 409. Thus, this design of closure 112 helps to ensure that graphics and text printed on front and rear face panels 104, 106 in a top region of bag 100 can be viewed without substantial distortion when closure 112 is engaged. The two halves or strips of closure 112, which are attached to the front and rear face panels 104, 106, respectively, are sufficiently flexible when disengaged to allow the top portions of front and rear face panels 104, 106 to readily deform. This permits a user to easily access contents contained in bag 100.

Bag 100 is formed to have a bottom gusset 114 folded inwardly from the bottom edges of front and rear panels 104,106 and extending across the full length of the bag between side seals 107 and 108. Bottom gusset 114, as shown in FIG. 1, is formed by making three parallel folds in the single sheet of film from which body 102 of bag 100 is formed. To help maintain the sharpness of these folds, the folds can be creased and may even be set using thermal sealing or other techniques. The gusset folds along the bottom edges of front and rear face panels 104, 106 are not creased in this example, but can be creased to enable pre-made bags to be folded flat.

Figure 4:
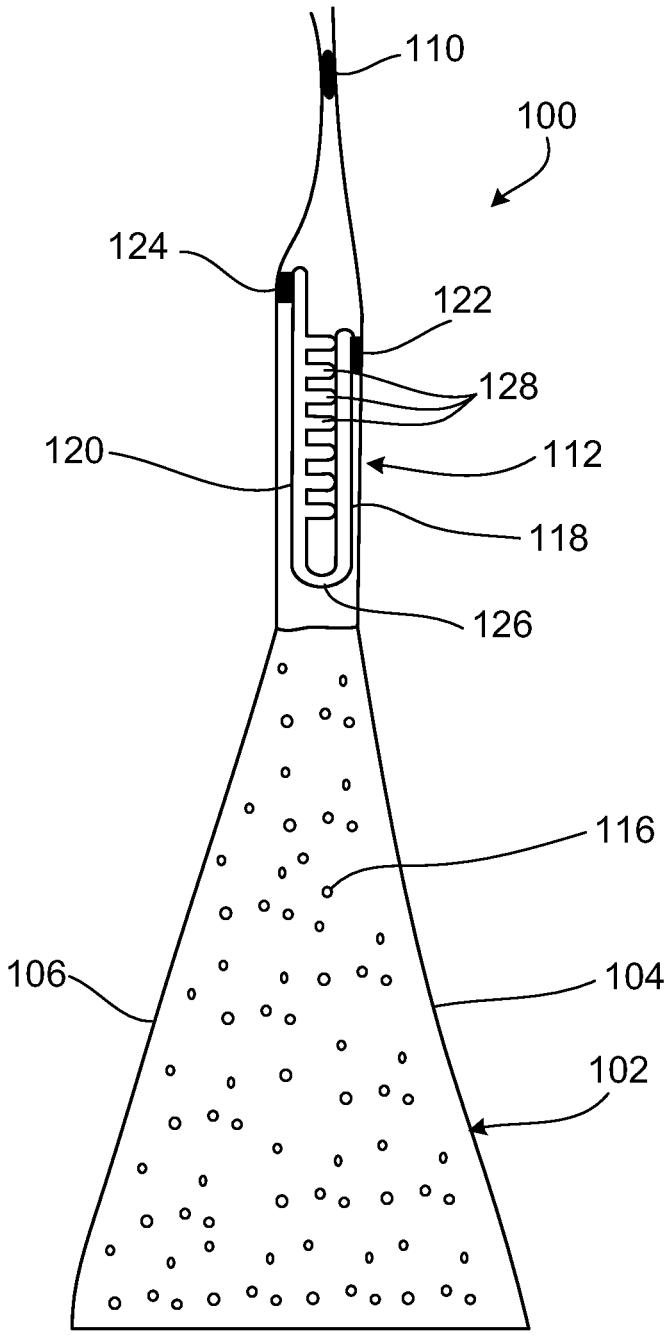
FIG. 4 is a cross-section of the bag of FIG. 1, taken along line 4-4 in FIG. 1 when the bag is full of contents.

FIG. 4 is a cross-sectional view through bag 100, which has been filled with a granular material 116. Bottom gusset 114 of bag 100 has expanded due to the contents 116 contained in the bag. As a result, the bottom of bag 100 is flat. Closure 112, as shown in FIG. 4, includes first and second halves or strips 118, 120. First and second halves 118, 120 of closure 112 are attached (e.g., by continuous thermal welds) along top edge regions 122, 124 to the inner surfaces of front and rear face panels 104, 106. Adhesives or other attachment techniques can alternatively or additionally be employed to attach closure 112 to front and rear face panels 104, 106. First and second halves 118, 120 are held together by a thinned tear region or groove 126 of closure 112. Closure 112 is folded along tear region 126 in a manner such that fastener elements or projections 128 that integrally extend from first and second halves 118, 120 of closure 112 releasably engage one another to hold closure 112 in a closed position. In addition to seal 110 along the top edge region of bag 100, closure 112 provides a tamper evident seal for bag 100. The engaged closure 100 provides those portions of front and rear face panels 104, 106 adjacent the closure with support, which helps to prevent those portions of front and rear face panels 104, 106 from becoming deformed and distorting text or graphics printed thereon. The granular contents 116 in bag 100 acts as a support for those portions of front and rear face panels 104, 106 below closure 112, and thus helps to prevent those portions of panels 104, 106 from becoming deformed.

Figure 5:
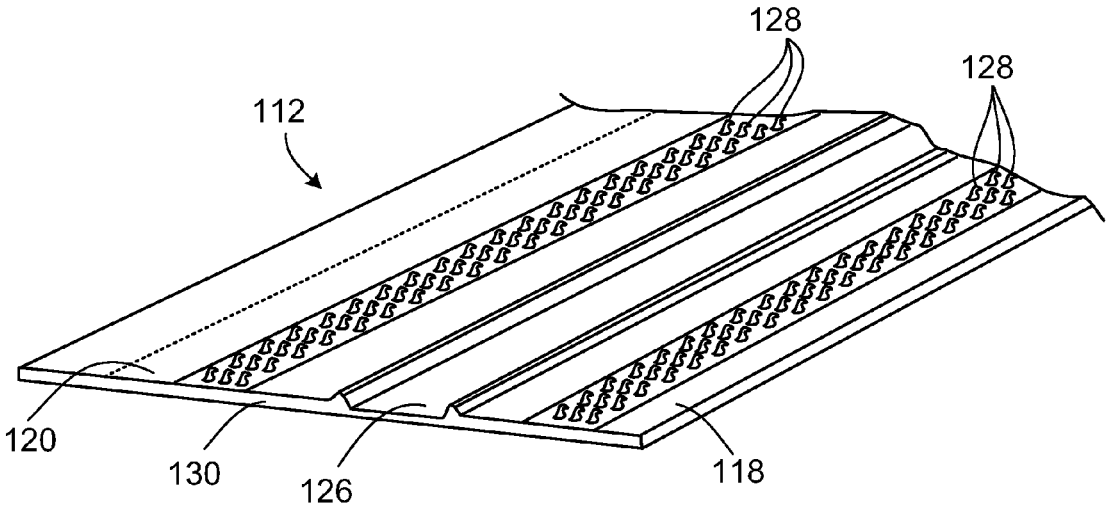
FIG. 5 is a perspective view of the self-engaging fastener closure of the bag of FIG. 1.

FIG. 5 illustrates closure 112 in a flat configuration, prior to being closed and attached to bag body 102. As shown in FIG. 5, closure 112 includes a thin, sheet-form resin base or substrate 130 (of polyethylene, for example) with lengthwise-continuous, parallel bands of fastener elements 128 on its front face. Bands are equally spaced from central groove or tear region 126 of closure 112, such that when closure 112 is folded longitudinally at groove 126, fastener elements 128 of first closure half 118 engage and retain fastener elements 128 of second closure half 120 to form a releasable fastening. Closure 112 typically has an overall width of about 0.5 inches to about 3.0 inches (e.g., about 1.25 inches) and a nominal thickness of about 0.020 inch to about 0.125 inch (e.g., about 0.064 inch). Bands of fastener elements 128 each typically have a width of about 0.15 inch to about 0.75 inch (e.g., about 0.375 inch). Groove 126 is typically about 0.002 inch to about 0.004 inch deep and extends over a width of about 0.125 inch. Thus, at groove 126, closure 112 has a reduced thickness of about 0.002 inch to about 0.004 inch. On either side of groove 126, tear-limiting ribs rise another 0.002 inch to about 0.005 inch from the nominal surface of the closure base to resist propagation of tears from groove 126 into either of the fastener bands.

Figure 6:
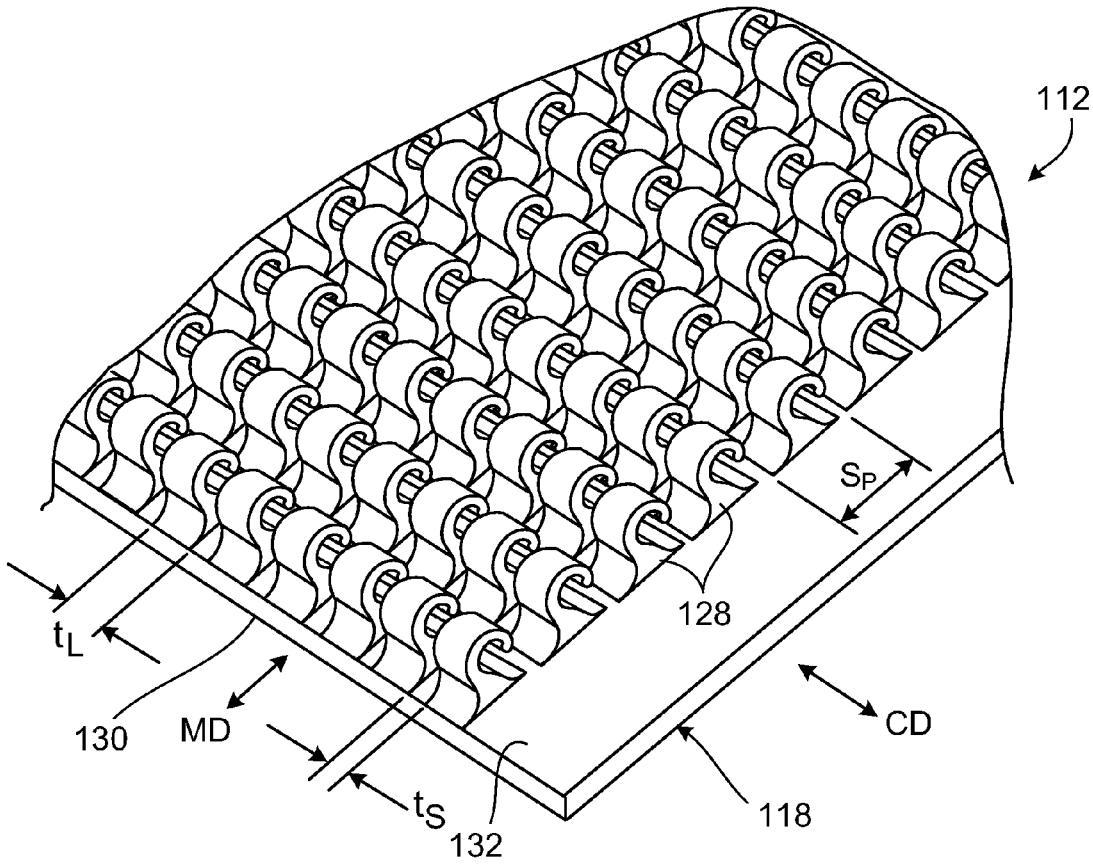
FIG. 6 is an enlarged partial view of one half of the self-engaging fastener closure of the bag of FIG. 1.

FIG. 6 is an enlarged view of a portion of first closure half 118. As shown, in first closure half 118, flexible resin base 130 has a broad upper fastening surface 132 from which fastener elements 128 extend. Base 130 and fastener elements 128 can be formed by a continuous molding process of a single flow of resin, such that base 130 and fastener elements 128 together form a unitary and seamless resin mass, with fastener elements 128 extending contiguously and integrally with the upper surface of base 130. Such a unitary structure can be molded, for example, using a rotating mold roll (not shown) defining a large number of discrete fastener element-shaped cavities about its periphery, as taught by Fischer in U.S. Pat. No. 4,872,243, the entire contents of which are incorporated herein by reference. The machine direction of such a process would normally be as illustrated by arrow MD, for example.

Figure 7:
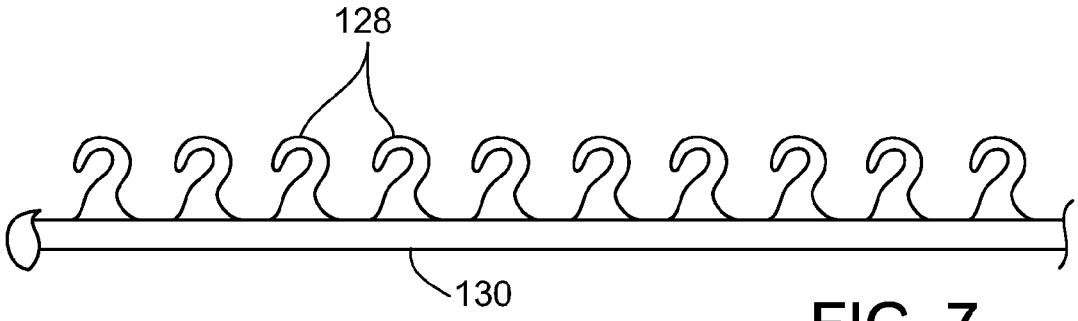
FIG. 7 is a side view of one half of the self-engaging fastener closure of the bag of FIG. 1.

In this configuration, fastener elements 128 are arranged in parallel rows and orthogonal columns. The columns extend in the machine direction MD, and the rows extend perpendicular to the columns, in the cross-machine direction CD. All fastener elements 128 face in a common machine direction, rather than in opposite directions. Adjacent rows are separated by fastener element-free lanes, such that one could look across the entire product in the cross-machine direction and see open space between adjacent fastener elements of the near column, as illustrated in the side view shown in FIG. 7 (reversed to show the fastener elements 128 facing in the opposite direction).

Figure 8:
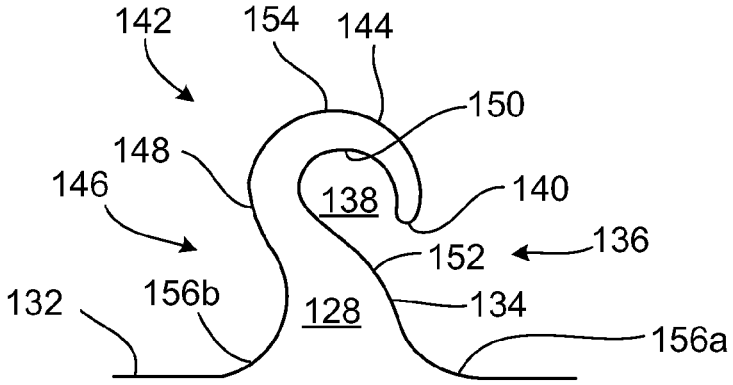
FIGS. 8 and 9 are enlarged side views of one of the self-engaging fasteners of the closure of the bag of FIG. 1.

Referring next to FIG. 8, each fastener element 128 has a molded stem 134 tapering in width and extending from the broad surface 132 of base 130 to a curved head 144 that extends toward a front side 136 of the fastener element, forms a crook 138 and ends in a distal tip 140. Each fastener element 128 has a back side 142 opposite its front side. The curved head 144 protrudes beyond stem 134 on the back side 142 of the fastener element to form an overhang 146 defined by an overhang surface 148 of the head directed toward base 130 but not extending toward the base as does tip 140. The crook 138 formed by curved head 144 is defined in part by an underside head surface 150 that overhangs a lower portion 152 of stem 134. Curved head 144 has an upper surface 154 that extends from tip 140 to overhang surface 148 without inflection. In this example upper surface 154 forms a smooth, inflection-free curve from tip 140 to overhang surface 148, and follows a radius from the tip to the overhang surface, the radius having a center of curvature approximately centered over lower portion 152 of stem 134 between front and rear stem fillets 156*a* and 156*b*, such that a highest elevation of the curved head is also approximately centered over the lower stem portion. Tip 140 of the J-hook-shaped fastener element 128 is "reentrant" in the sense that it is directed downward toward the base of the product, rather than upward away from the base. The illustrated fastener elements 128 each define only one crook, with heads ending in only one tip, as opposed to palm tree type fastener elements that have a head extending equally in two opposite directions, defining two crooks and ending in two tips. The back side of fastener element 128 forms no crook.

Figure 9:
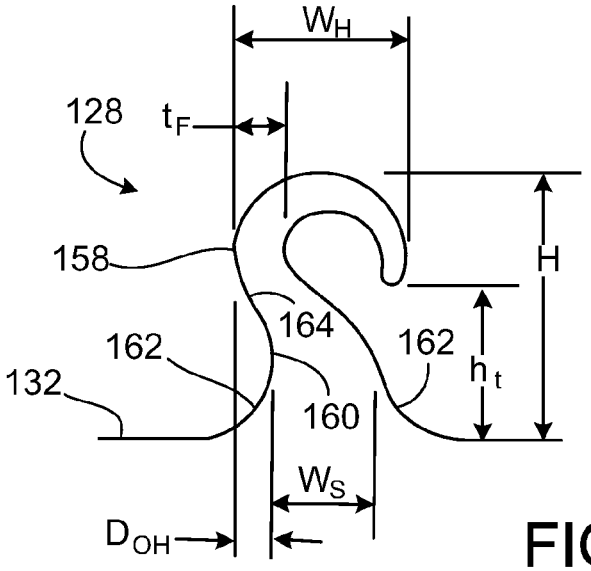

FIG. 9 illustrates certain dimensions and features of fastener elements 128. The rearmost extent 158 of curved head 144 extends rearward of the foremost extent 160 of the back side of the stem by an overhang distance $D_{OH}$, measured parallel to the broad surface 132 of the base, of about 0.0025 inch to about 0.0091 inch (e.g., about 0.0046 inch), which is more than about 10 percent of the overall width $W_H$ of curved head 144, measured parallel to the base, which is about 0.012 inch to about 0.084 inch (e.g., about 0.042 inch). The stem has a width $W_S$, measured fore-raft parallel to the base at the elevation of the foremost extent 160 of the back side of the stem, of about 0.0069 inch to about 0.0438 inch (e.g., about 0.0219 inch). This stem width is greater than 50 percent of the overall curved head width $W_H$. The front and back sides of the fastener element join the upper surface 132 of the base at curved fillets 162. The fillet radius at the front side of the stem is about 0.004 inch to about 0.060 inch (e.g., about 0.030 inch), while the fillet radius at the back side of the stem is about 0.006 inch to about 0.036 inches (e.g., about 0.018 inch). The overhang surface on the back side of the fastener element defines an inflection point 164 between the upper surface of the curved head and the curved back surface of the stem formed by the rear fillet, such that the upper curved head surface and the curved stem surface blend together in a smooth, continuous curve. The curved back surface of the stem, as formed by the rear fillet, and the upper surface of the curved head each define a similar radius of curvature, the heads of the fastener elements nesting in the rear fillets of a mating fastener product.

The stem and curved head together form a single continuous projection from base surface 132 to tip 140, defining a constantly narrowing flow thickness so as to enable extraction from a similarly shaped mold cavity without cavity opening. The curved head defines a flow thickness $t_F$, measured at the rearmost extent 158 of the crook, of about 0.0036 inch to about 0.025 inch (e.g., about 0.0126 inch). This flow thickness is less than half of the overall lateral thickness of the head (i.e., the dimension perpendicular to the view as shown in FIG. 9). As shown in the perspective view of FIG. 6, the lateral sides of fastener elements 128 are planar and parallel in this example, such that the overall lateral head thickness is the same as the overall lateral thickness $t_L$ of the fastener element and the only fastener element overhang is in the machine direction. In the example shown, $t_L$, is about 0.008 inch to about 0.024 inch (e.g., about 0.012 inch), the fastener elements being molded in complete form in cavities provided in mold rings of a similar thickness.

Still referring to FIG. 9, fastener elements 128 extend to a height H of about 0.0193 inch to about 0.113 inch (e.g., about 0.056 inch), and have a tip height $h_t$ of about 0.0109 inch to about 0.064 inch (e.g., about 0.032 inch). The tip has a tip radius of about 0.0008 inch to about 0.0055 inch (e.g., about 0.0027 inch). For many applications, the fastener element will have an overall height of less than about 0.070 inch, measured from broad surface 132 of the base, and the dimensions provided may be scaled accordingly to produce fastener elements of an identical shape but of differing sizes.

Figure 10:
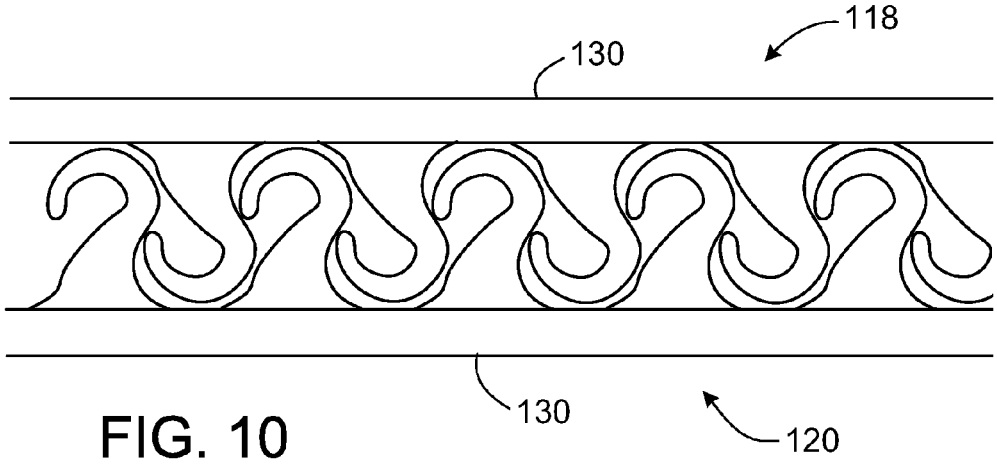
FIG. 10 illustrates a side view of the self-engaging fastener closure of the bag of FIG. 1 with the halves of the closure engaged with one another.

Referring again to FIG. 6, the fastener elements 128 of each row are aligned such that their respective heads form spaced-apart portions of a segmented rib extending across the width of the product. When two such fastener products are brought together for engagement, as shown in FIG. 10, each row of fastener elements of one closure strip is disposed between adjacent rows of fastener elements of the other mated closure strip. In other words, the lanes between the rows or ribs of one closure strip are sized and arranged to receive the rows or ribs of the other closure strip. The fastener element arrays of each product are configured with identical spacing between rows and with identically sized and shaped fastener elements 128. In the illustrated example, the fastener elements of adjacent columns are separated by a spacing thickness $t_s$ of about 0.004 inch to about 0.012 inch (e.g., about 0.006 inch), or about one-half of the fastener element thickness. The fastener elements are arranged in an array having a fastener element density of about 150 fastener elements per square inch to about 4000 fastener elements per square inch (e.g., about 700 fastener elements per square inch). In this example the fastener element pitch spacing $S_P$ along each column is less than twice the overall width of the fastener element heads ($W_H$ in FIG. 9), such that when two identical closure strips are mated, there is interference between the fastener element heads of the two closure strips, and there must be temporary deformation of the fastener elements to achieve engagement.

Figure 11:
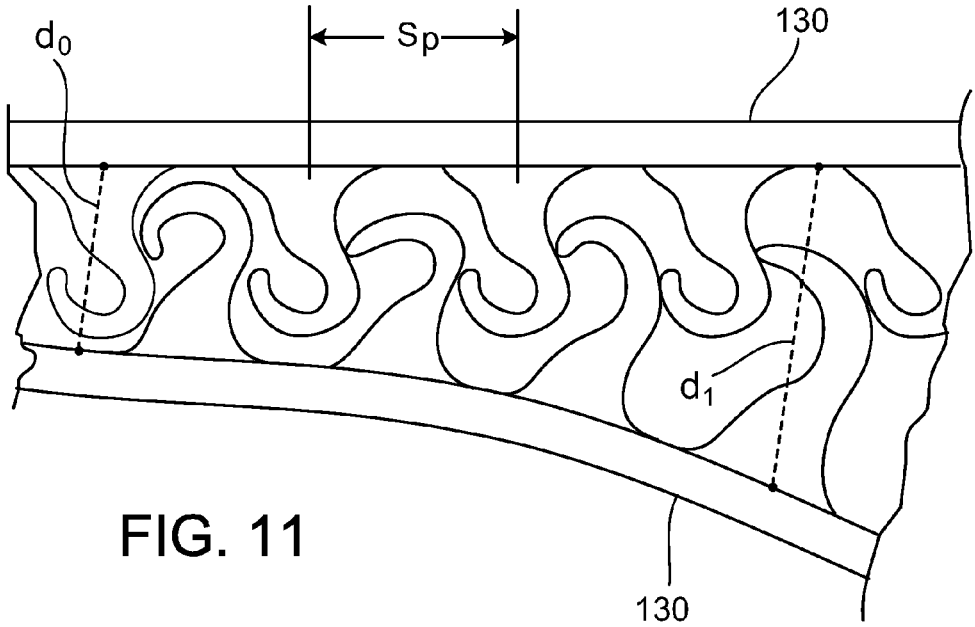
FIG. 11 illustrates a side view of the self-engaging fastener closure of the bag of FIG. 1 as the halves of the closure are being peeled apart from one another.

In the mating engagement illustrated in FIG. 10, the fastener elements 128 of both mated closure strips 118, 120 face in a common direction, with the front sides of the fastener elements of one product facing the back sides of the fastener elements of the other, and vice versa. FIG. 11 illustrates the progressive fastener element head deformation that occurs when such a mated arrangement is peeled apart in the machine direction. As one base 130 is flexed away from the other, the fastener elements 128 extending from that base are progressively distended, their tips pressing against, and remaining generally stationary with respect to, the back sides of corresponding fastener elements of the other product during the distension. As shown in FIG. 11, at any given time there are multiple rows of fastener elements undergoing different stages of head distension. Subjectively, this progressive distension produces a rather smooth, pleasing peel force, in some cases feeling more like peeling off an adhesive surface than peeling apart a self-engaging fastener closure. It is believed that the smoothness of the peel is at least in part a result of the relatively high distension length with respect to the fastener element pitch spacing. By "distension length" we mean the difference in length of a line segment connecting the midpoint of a fastener element base with a midpoint of the respective spacing between fastener elements of the other product, between full engagement at rest (i.e., with no normal load applied), and the instant at which the tip disengages from the other fastener product during a standard peel test conducted in accordance with ASTM D 5170-98. In FIG. 11, such distances are approximately illustrated as $d_0$ and $d_1$. We call the ratio of this distension length ($d_1$-$d_0$) to pitch spacing $S_P$ the distension overlap. In other words, distension overlap is defined as $(d_1-d_0)/S_P$. In some embodiments, this distension overlap is around 90 percent. It is believed that, all other parameters equal, the higher the distension overlap, the less peel force ripple will be perceived during disengagement, resulting in a smoother, more adhesive-like peel.

If a less smooth peel is desired, the tip-back engagement configuration can be modified (e.g., by altering the static coefficient of friction and/or engagement angle between the tips and fastener element backs), such that the fastener element crooks of the flexed closure strip are compressed, rather than distended, to separate from the other closure strip. In such a configuration, the tips of the moving fastener elements slide along the back surfaces of the other fastener elements, rather than remaining relatively stationary as illustrated. Such an arrangement is similar to many other self-engaging fastener products, in which each row of elements separates over a relatively narrow range of motion. In some such products, such as some rigid-head mushroom-shaped products, the interfering edges of the mating fastener elements "snap" against each other both during engagement arid disengagement. By way of contrast, the fastener elements shown in FIGS. 6-11 produce a tangible and tactile engagement "bump" or "snap" as they are brought into engagement face-to-face, while subsequently peeling apart with a very smooth feel.

While closure 112 has been described as having fastener elements 128 that all extend in a common direction and in aligned columns and rows, fastener elements 128 of closure 112 can alternatively have any of the various other configurations described in U.S. Patent Application Publication No. 2009/0010735, which is incorporated by reference herein. For example, in certain embodiments, each column of fastener elements includes a neighboring column in which the hooks of the fastener elements are oriented in the opposite direction (i.e., 180 degrees relative to the hooks of its neighboring fastener elements). In addition, the dimensions and materials of the base and fastener elements of closure 112 can vary from those dimensions and materials described above so long as the stiffness of the engaged closure and the stiffness of the disengaged closure fall within desired ranges. In certain embodiments, for example, closure 112 is formed of polypropylene and/or other polymeric materials, rather than polyethylene.

Bag 100 is typically delivered (e.g., sold) to the consumer in the configuration shown in FIG. 4. In particular, when delivered to the consumer, bag 100 is filled with contents (e.g., granular material) 116 and is sealed by both the unbroken closure 112 and top seal 110. Referring to FIGS. 1 and 4, to initially open bag 100, body 102 is cut or torn between closure 112 and top seal 110. In some cases, this region of body 102 can include a perforation that allows the user to easily tear away the top region of body 102 along the perforation. In certain cases, a tear strip is provided in the region of body 102 between closure 112 and top seal 110. In such cases, the user can grasp and pull the tear strip to remove the top region of body 102 from the remainder of body 102 along the path of the tear strip. Alternatively, the user can simply cut the top region of body 102 from the remainder of body 102 using scissors, a knife, or any other sharp instrument.

Figure 12:
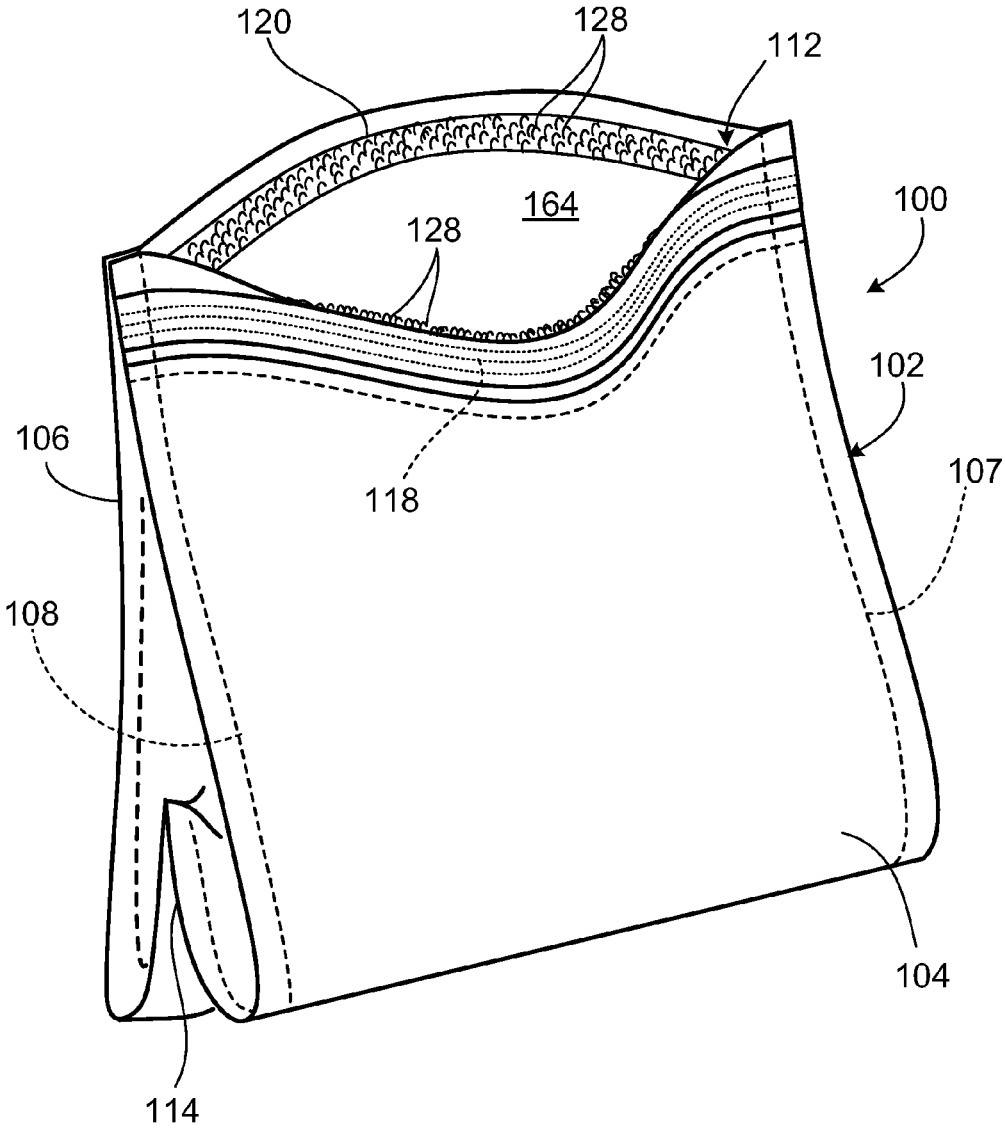
FIG. 12 is a perspective view of the bag of FIG. 1 with the halves of the self-engaging fastener closure disengaged from one another such that a user can access contents in the bag.

Referring now to FIGS. 4 and 12, after gaining access to closure 112, the first and second halves 118, 120 of closure 112 are grasped in separate hands, and pulled laterally away from each other to burst through the frangible tear region 126 running along the central portion of closure strip 112 between the first and second halves 118, 120. As a result, the first and second halves 118, 120 become detached from one another and an access opening 164 is formed along the upper end of bag 100 between the first and second halves 118, 120 of closure 112. When first and second halves 118, 120 of closure 112 are separated from each other in this manner and fastener elements 128 of first and second halves 118, 120 are not engaged with one another, the portions of bag body 102 to which first and second halves 118, 120 are attached are sufficiently flexible to flop or droop to either side of opening 164, as shown in FIG. 12. This flexibility allows the user to insert and withdraw his or her hand through opening 164 without significant disruption from closure 112. While text and graphics on the portions of bag body 102 adjacent closure halves 118, 120 may become distorted due to the flexibility and resulting deformation (e.g., drooping or folding) of those portions of bag body 102 and closure halves 118, 120, it will be understood that the clarity of such text and graphics is typically not of great concern while the bag is in use.

Bag 100 can be reclosed between uses, such as for post-sale storage. To reclose the bag 100, the exposed faces of closure halves 118, 120 are brought back into facial contact to engage the mating fastener elements 128. The two closure halves 118, 120 can be readily brought into useful engagement because only very minimal alignment and contact pressure is required. The closure halves 118, 120, for example, are releasably fastenable in multiple relative positions spaced along each of two perpendicular directions. The bag may be reclosed and reopened multiple times to regain access to the bag contents.

It has been found that closure 112, along with the film of bag body 102 in the area of the closure, has a maximum bending stiffness with the first and second closure halves 118, 120 engaged, that is at least 10 times the maximum bending stiffness of closure halves 118, 120 taken individually with their associated face panels 104, 106. It has further been discovered that a closure having such qualities is particularly advantageous for use in bags having flexible walls, such as bag 100.

Figure 13:
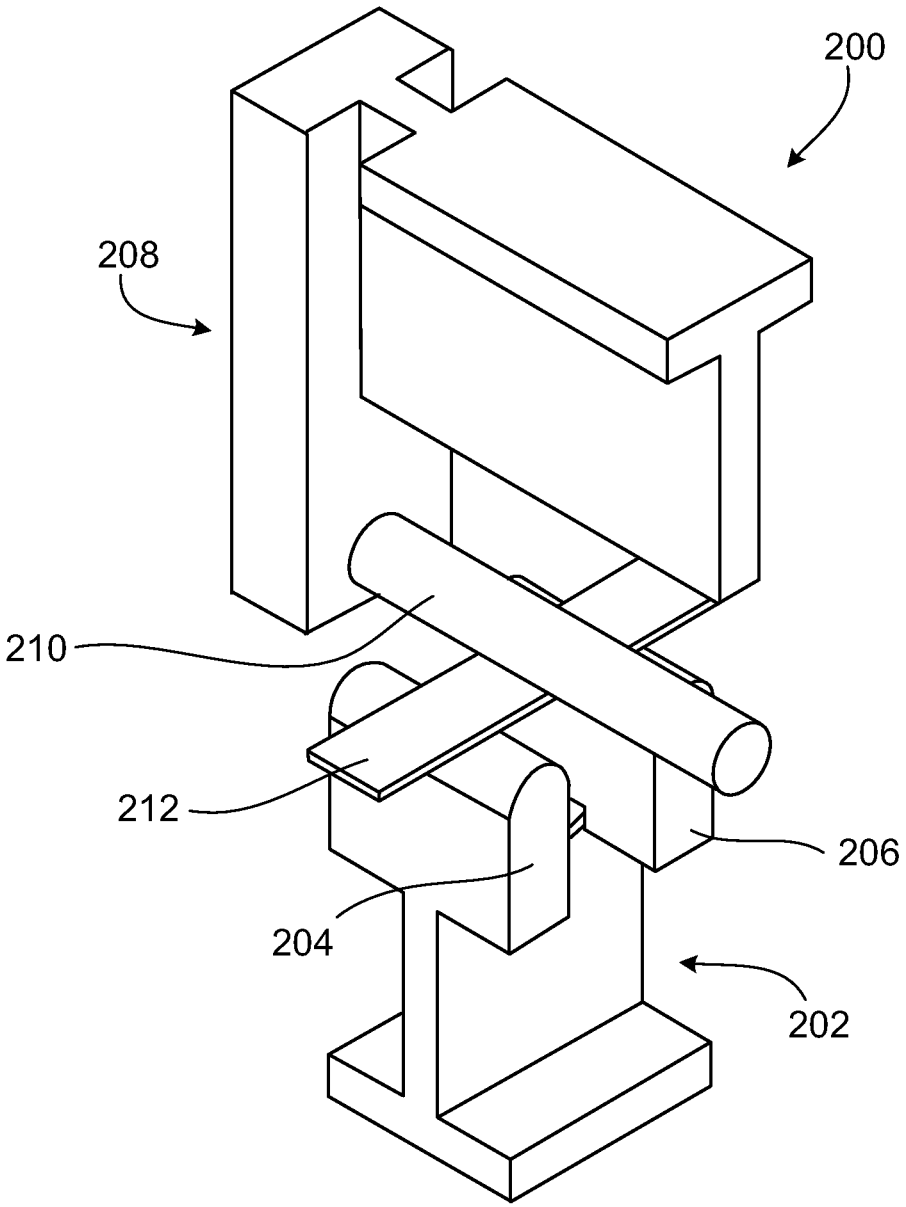
FIGS. 13-15 are perspective, side, and front views, respectively, of a bending stiffness testing apparatus.
Figure 14:
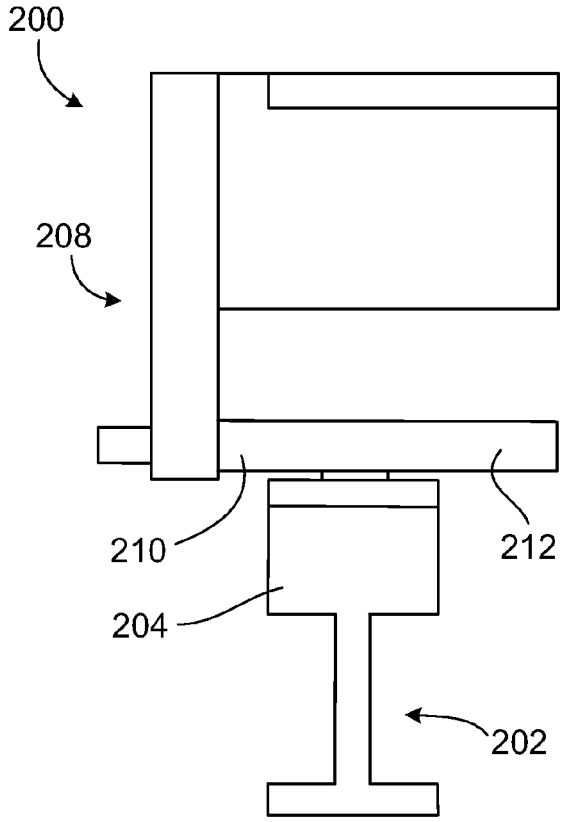
Figure 15:
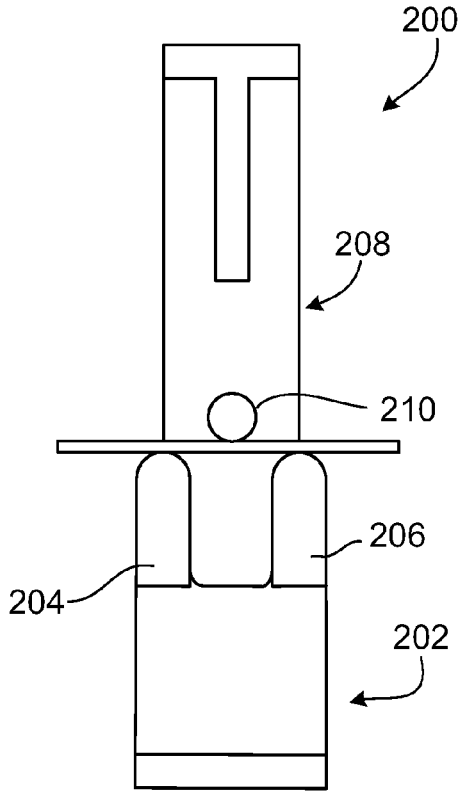

The stiffness of closure 112 in combination with the bag walls and the stiffness of first closure half 118 in combination with its attached bag wall (or second closure half 120 in combination with its attached bag wall) are determined using a test that is very similar to ASTM D 790-03, Procedure B. FIGS. 13-15 illustrate perspective, side, and front views, respectively, of an apparatus 200 used to test the maximum bending stiffness of closure 112 and adjacent portions of bag body 102. Apparatus 200 includes a support base 202 that has two vertically extending supports 204, 206. Each of supports 204, 206 has a rounded top surface having a radius of about 5.0 millimeters. Supports 204, 206 are spaced apart from one another by about one inch as measured from the apexes of the rounded top surfaces of supports 204, 206. A vertically movable frame 208 is positioned above support base 202. A contact cylinder 210 extends horizontally from frame 208 and is positioned approximately midway between supports 204, 206. Contact cylinder 210 has a radius of about 5.0 millimeters. As frame 208 moves downward, contact cylinder 210 passes between supports 204, 206. A test sample 212 is positioned on supports 204, 206 and is approximately centered relative to supports 204, 206 such that end regions of test sample 212 extend laterally beyond supports 204, 206. This helps to ensure that test sample 212 does not fall into the space between supports 204, 206 when test sample 212 is deflected during the test procedure described below. Apparatus 200 is equipped with a load cell to measure the force that contact cylinder 210 encounters as frame 208 moves downward. As the contact cylinder 210 moves downward deflecting test sample 212 the load cell outputs the force required for contact cylinder 210 to bend test sample 212. This output data is saved in memory. Upon completion of the test, the maximum bending force can be determined from the data output by the load cell.

Figure 16:
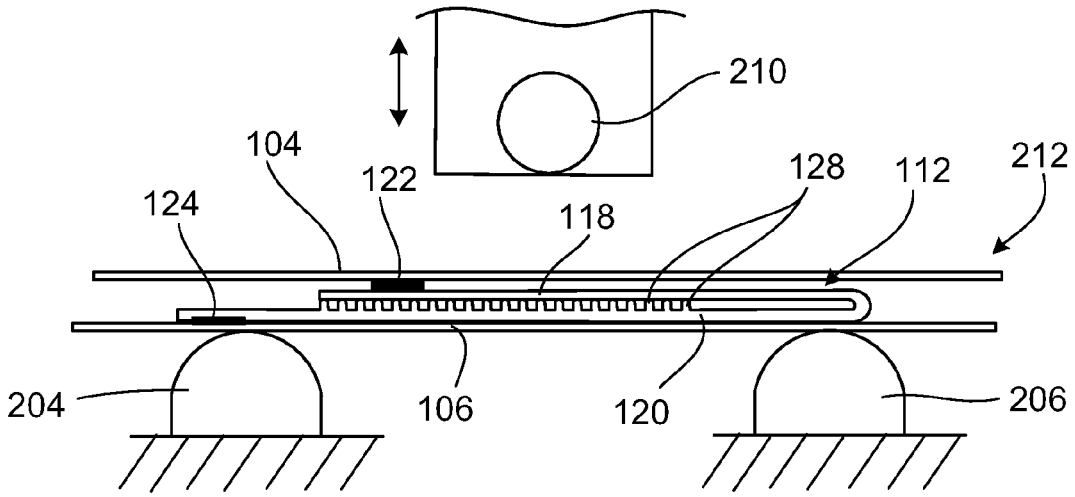
FIG. 16 illustrates the apparatus of FIGS. 13-15 being used to determine the maximum bending stiffness of the self-engaging fastener closure and bag walls of the bag of FIG. 1 when the closure is engaged.

The test for determining the maximum bending stiffness of the engaged closure 112 in combination with the portions of front and rear face panels 104, 106 adjacent to closure 112 will now be described with reference to FIG. 16, which is a close up view of test sample 212 (i.e., a 2.0 inches long by 0.5 inch wide cut-out of the portion of bag 100 including engaged closure 112 and the portions of bag body 102 adjacent to closure 112) resting on supports 204, 206 of testing apparatus 200. Test sample 212 is first cut from bag 100 using any of various suitable cutting techniques. Test sample 212 is then centered over and rested on supports 204, 206. Contact cylinder 210 is then moved downward at a rate of about 0.2 inches/minute, deflecting test sample 212. Contact cylinder 210 continues to apply a force to test sample 212 until failure occurs. As test sample 212 is deflected, the deflection force (i.e., the force that contact cylinder 210 encounters as frame 208 moves downward and deflects test sample 212) is continuously measured by the load cell of apparatus 200. The measured deflection force data can be used to determine the point at which a peak load (pound-force) was applied to test sample 212. The peak load can, for example, be determined by plotting the measured deflection force data on a graph and identifying a spike in the curve of the graph. The peak load is indicative of the maximum bending stiffness of test sample 212. This test procedure is repeated five times (on five individual samples), and the five determined peak loads are averaged to determine an average maximum bending stiffness of the test samples.

Figure 17:
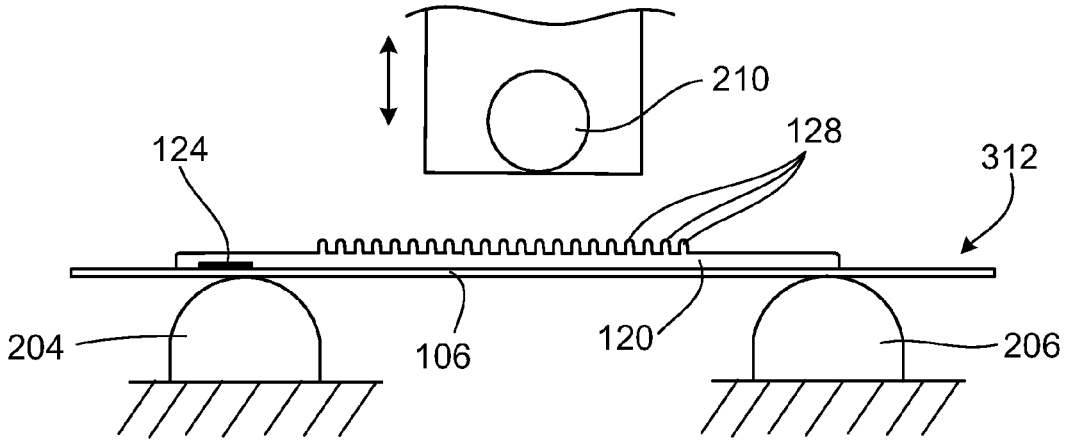
FIG. 17 illustrates the apparatus of FIGS. 13-15 being used to determine the maximum bending stiffness of one of the bag walls of the bag of FIG. 1 in combination with the half of the self-engaging fastener closure that is attached to that bag wall.

After determining the peak load associated with test sample 212, another 2.0 inches long by 0.5 inch test sample is cut out of another portion of bag 100 including engaged closure 112. Closure 112 is then opened and one of the closure halves 118, 120, with its associated piece of bag body 102 (i.e., associated piece of front face panel 104 or rear face panel 106) still attached, is centered over and rested on supports 204, 206. In the example shown in FIG. 17, second closure half 120 and its respective bag body portion is provided as a test sample 312. After positioning test sample 312 on supports 204, 206 in a manner such that end regions of test sample 312 extend laterally beyond supports 204, 206, contact cylinder 210 is moved downward at a rate of about 0.2 inches/minute, deflecting test sample 312. Test sample 312 is deflected until failure occurs. In the manner discussed above, the deflection force is continuously measured by apparatus 200, and the measured deflection force data is used to determine the point at which a peak load (pound-force) was applied to test sample 312 during the test. This test procedure is repeated five times (on five individual samples), and the five determined peak loads are averaged to determine an average maximum bending stiffness of the test samples.

The average maximum bending stiffness (or the average peak load) of the five test samples 212 is then divided by the average maximum bending stiffness (or the average peak load) of the five test samples 312 to determine a ratio of the maximum bending stiffness of the engaged closure 112 and its two attached bag wall portions to the maximum bending stiffness of one half of the engaged closure 112 and its attached bag wall portion. For the bag constructions described herein, this stiffness ratio will be at least 10:1 (e.g., at least 15:1, at least 20:1). The stiffness ratio can, for example be 10:1 to 30:1 (e.g., 10:1 to 20:1, 15:1 to 25:1). As discussed above, it has been found that stiffness ratios determined to be within these ranges (using the test procedure described above) are advantageous for bags having flexible walls (e.g., thin film walls) as they tend to provide the bag walls with sufficient stiffness when the closures are engaged to clearly display text and graphics printed on the bag walls and also allow the bag walls to have sufficient flexibility when the closures are disengaged to enable easy access to the contents of the bag.

The above-described test set up differs slightly from ASTM D 790-03. The primary difference between that ASTM D 790-03 test set up and the test set up used to determine the maximum bending stiffness of closure 112 in combination with the bag walls and the maximum bending stiffness of the first closure half 118 in combination with its attached bag wall portion (or second closure half 120 in combination with its attached bag wall portion) is that contact cylinder is positioned so that its length extends in a horizontal plane (i.e., in a plane parallel to the test sample) while the ASTM test calls for a loading nose that is arranged in a vertical plane (i.e., perpendicular to the plane in which the test sample is positioned). It has been found that the horizontal arrangement of contact cylinder reduces the likelihood, relative to a vertically positioned cylinder, of the cylinder slipping off of the test sample during the test procedure. In addition, in the above-described test, the deflection force is measured directly by the load sensor. The maximum bending stiffness can alternatively or additionally be determined by first measuring movement of contact cylinder 210 relative to supports 204, 206 and/or by measuring deflection of test samples 212, 312, relative to supports 204, 206, as described in ASTM D 790-03. To enable apparatus 200 to measure this movement of contact cylinder 210 or test samples 212, 312, apparatus 200 can be equipped with a gage positioned on frame 208 or in contact with the bottom surface of test sample 212 at a midpoint along the length of test sample 132.

While certain embodiments have been described, other embodiments are possible. For example, while closure 112 has been described as a unitary closure having first and second separable halves 118, 120, in certain embodiments, a closure having two separate closure strips can be provided. In such embodiments, the closure strips can be separately attached (e.g., welded) to their respective bag walls and then engaged, or the closure strips can be engaged and then simultaneously attached (e.g., welded) to their respective bag walls.

In addition, while first and second closure halves 118, 120 have been illustrated as being attached to their respective bag panels 104, 106 along only top regions of those closure halves, other areas of closure halves 118, 120 can be attached to panels 104, 106. In certain embodiments, for example, top and bottom regions of one or both of closure halves 118, 120 are attached to bag panels 104, 106.

Figure 18:
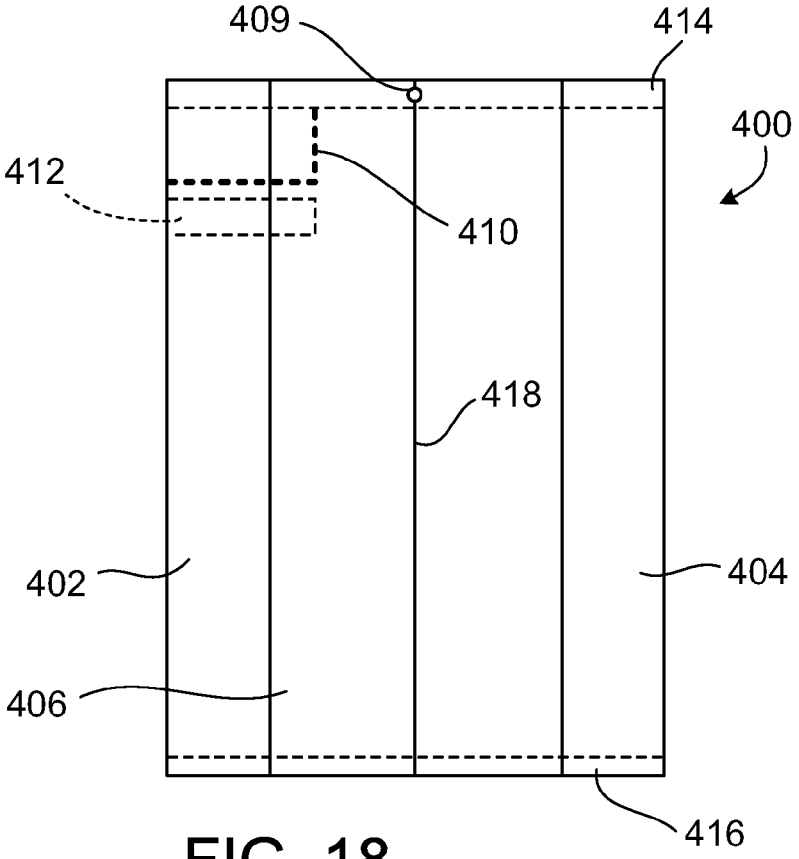
FIG. 18 is a front view of a bag including a self-engaging fastener closure welded between walls of the bag that form a side gusset in a manner such that a pour spout can be formed at the side of the bag when the fasteners are disengaged from one another and the side gusset is expanded.

While bag 100 has been described as having a bottom gusset and as having closure 112 attached to a top region of the bag, other bag constructions and closure placements can be used. As shown in FIG. 18, for example, a bag 400 includes side gussets 402, 404 that allow the bag to expand. In this example, bag walls 406, 408 are attached (e.g., welded) along their top and bottom edge regions 414, 416, and rear wall 408 includes a seal 418 extending along its height, from top region 414 to bottom region 416. An aperture 409 is formed through top sealed region 414 of bag 400 to allow bag 400 to be hung from a display. A closure 412 is positioned between and attached to front and rear walls 406, 408 of bag 400 in the region of side gusset 402. Closure 412 can be attached to bag walls 406, 408 using any of the various attachment techniques described above.

Figure 19:
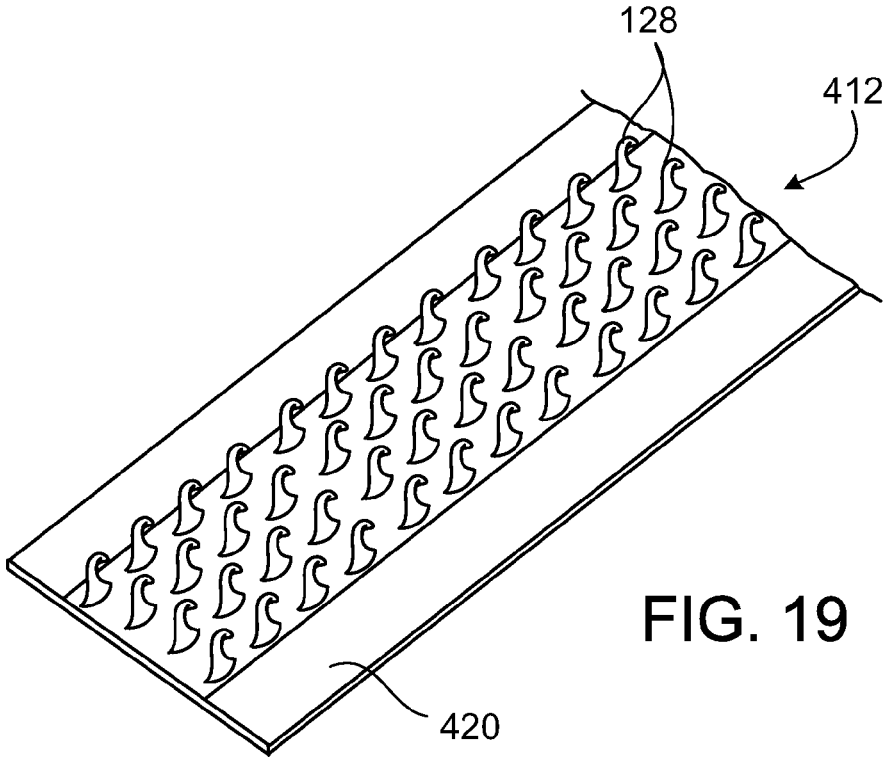
FIG. 19 is a perspective view of the self-engaging fastener closure of the bag of FIG. 18.

Referring briefly to FIG. 19, closure 412, like closure 112, includes self-engaging fastener elements 128 extending from a resin base 420. However, only one band of fastener elements 128 is provided along the length of closure 412. Closure 412 is otherwise similar to closure 112 and provides the portion of bag 400 including closure 412 with an engaged/disengaged stiffness ratio similar to that of bag 100.

Figure 20:
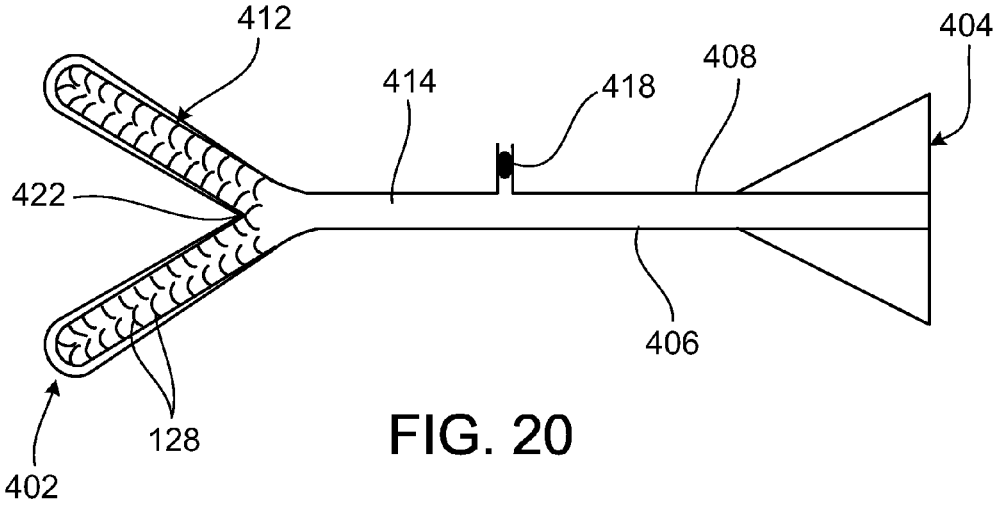
FIG. 20 is a top view of the bag of FIG. 18 when the closure is engaged.
Figure 21:
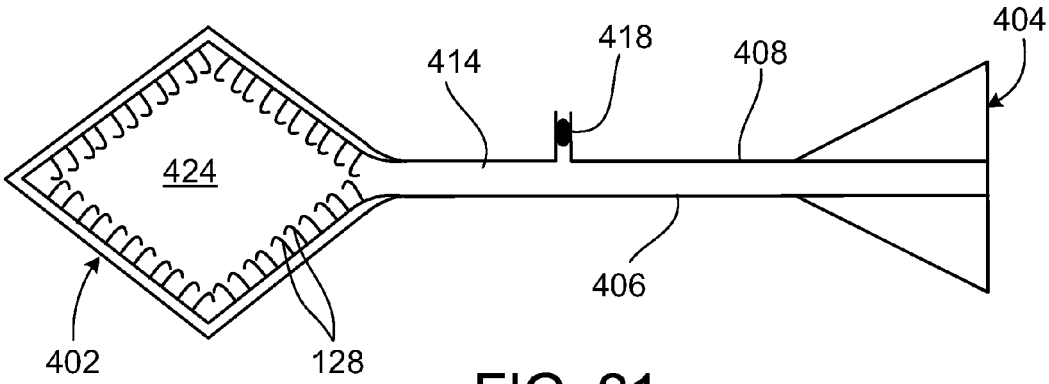
FIG. 21 is a top view of the bag of FIG. 18 when the closure is disengaged and the side gusset is expanded to form a pour spout.

Referring again to FIG. 18, a perforation 410 is provided through bag walls 406, 408. When the consumer wishes to gain access to contents in bag 400, he or she tears bag 400 along perforation 410 to remove a top corner region of bag 400. Referring now to FIG. 20, which is a top view of bag 400 after removing the top corner portion of bag 400, engaged closure 412 is exposed to the consumer after tearing bag 400 along perforation 410. To open closure 412 and thus gain access to the bag contents, the consumer grasps a folded portion 422 and pulls laterally away from the interior of bag 400, which causes fastener elements 128 to disengage from one another and expands side gusset 402. As shown in FIG. 21, with gusset 402 expanded, an opening 424 is defined between inward facing surfaces of closure 412. In this manner, the expanded side gusset 402 in the region of closure 412 can be used as a pour spout to conveniently pour bag contents out of the bag. After use, closure 412 can be re-engaged by re-folding side gusset 402 and then applying pressure to front and rear bag walls 406, 408 in the region of side gusset 402.

The maximum bending stiffness of the portion of bag 400 including closure 412 is tested in generally the same way as described above with respect to bag 100. First, one of the two engaged portions of side gusset 402 is tested, and then a portion of front or rear face panel 406, 408 to which a single, unengaged layer of closure 412 is attached is tested. A ratio of the maximum bending stiffness of the engaged closure 412 and its two attached bag wall portions to the maximum bending stiffness of closure 412 (in a disengaged state) and its single attached bag wall portion is typically at least 10:1 (e.g., at least 15:1, at least 20:1). The stiffness ratio can, for example be 10:1 to 30:1 (e.g., 10:1 to 20:1, 15:1 to 25:1). As discussed above, it has been found that stiffness ratios determined to be within these ranges (using the test procedure described above) are advantageous for bags having flexible walls (e.g., thin film walls) as they tend to provide the bag walls with sufficient stiffness when the closures are engaged to clearly display text and graphics printed on the bag walls and also allow the bag walls to have sufficient flexibility when the closures are disengaged to enable easy access to the contents of the bag.

Figure 22:
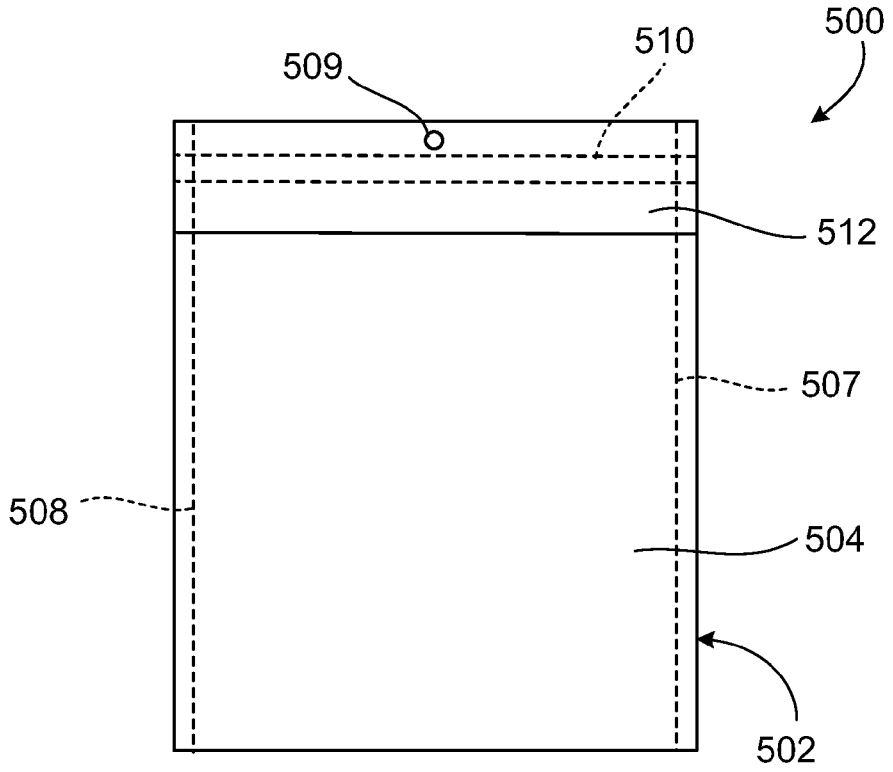
FIGS. 22 and 23 are front and side views, respectively, of a flat bag including a self-engaging fastener closure welded between front and rear walls of the bag.
Figure 23:
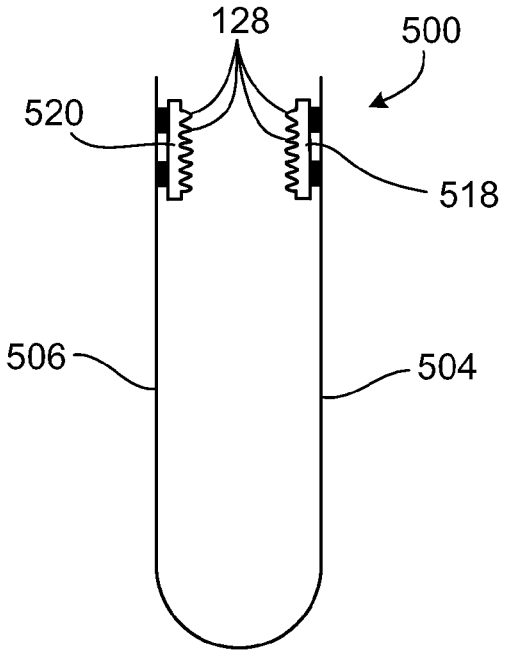

FIGS. 22 and 23 are front and cross-sectional side views, respectively, of a bag 500 that includes a bag body 502 formed of single sheet of plastic film. The sheet of film is folded in half and sealed along side edge regions 507, 508 and top edge region 510 to form a front face panel 504 and a rear face panel 506. An aperture 509 is formed in a top edge region of bag 500 to allow bag 500 to be hung from a display rack. A self-engaging fastener closure 512 includes a first closure strip 518 that is attached to front face panel 504 and a second closure strip 520 that is attached to rear face panel 506. Each closure strip 518, 520 includes a base from which an array of fastener elements 128 extend.

To gain access to the contents of bag 500, the bag is cut between top seal 510 and closure 512. Front and rear face panels 504, 506 or closure strips 518, 520 themselves can then be grasped and pulled away from one another to disengage fastener elements 128 from each other and create an opening leading to the interior volume of bag 500, as shown in FIG. 23.

Due to the construction of closure strips 518, 520 and front and rear face panels 504, 506, the portion of bag 500 including closure 512 can have an engaged/disengaged bending stiffness ratio falling within the ranges discussed above with regard to bags 100 and 400. As a result, when closure 512 is engaged and bag 500 is hanging from a display rack, the top corner regions of bag 500 will be prevented from flopping over and covering text and graphics printed on the front and/or rear face panels 504, 506. In contrast, when closure 512 is in a disengaged state, the portion of bag 500 including closure 512 will have sufficient flexibility to allow a user to comfortably access contents of the bag.

Figure 24:
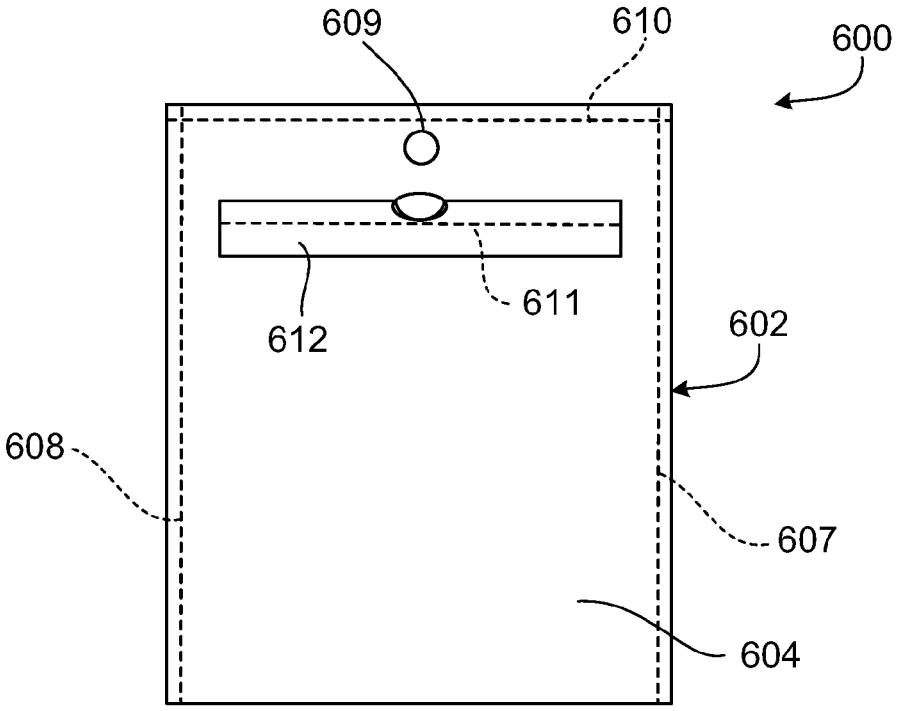
FIGS. 24 and 25 are front and side views, respectively, of a bag including a self-engaging fastener closure welded to a front face of the bag.
Figure 25:
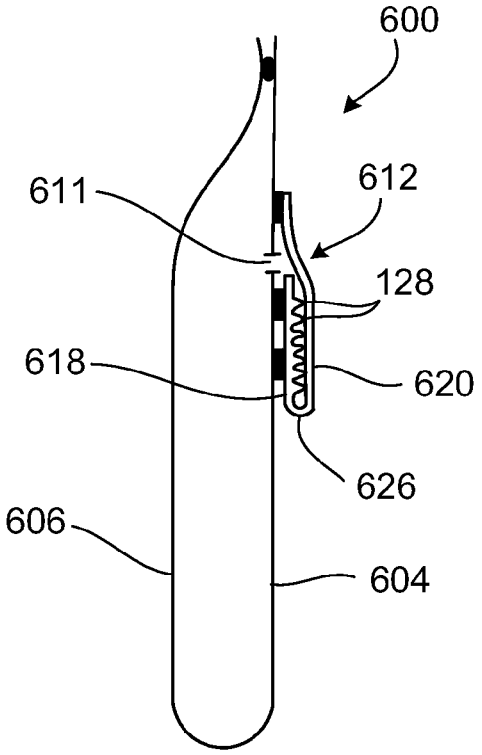

FIGS. 24 and 25 are front and cross-sectional side views, respectively, of a bag 600 that is similar in many ways to bag 500. Bag 600 includes a bag body 602 formed of single sheet of plastic film. The sheet of film is folded in half and sealed along side edge regions 607, 608 and top edge region 610 to form a front face panel 604 and a rear face panel 606. An aperture 609 is formed in a top edge region of bag 600 to allow bag 600 to be hung from a display rack. Front face panel 604 includes a perforation 611 that allows a user to tear through front face panel 604 to access contents in bag 600. Front face panel 604 could alternatively be provided with a tear strip to allow a user to tear through front face panel 604 to access contents in bag 600. A self-engaging fastener closure 612 similar to closure 112 discussed above is attached to front face panel 604 and covers perforation 611. Closure 612 includes a unitary folded base having a thinned tear region or groove 626. First and second strips 618, 620 of closure 612 reside on either side of tear region 626 and are connected to one another via tear region 626. Each of first and second strips 618, 620 includes a band of fastener elements 128. First closure strip 618 is attached to front face panel 604 below perforation 611, and second closure strip 620 is attached to front face panel 604 above perforation 611.

To gain access to the contents of bag 600, closure 612 is torn along tear region 626 and the separated strips 618, 620 of closure 612 are grasped and pulled away from one another to disengage fastener elements 128 from one another. Front face panel 604 is then torn at perforation 611 to create an opening leading to the interior volume of bag 600.

Due to the construction of closure strips 618, 620 and front face panel 604 of the portion of bag 600 including closure 612 can have an engaged/disengaged bending stiffness ratio falling within the ranges discussed above with regard to bags 100, 400, and 500. The test used to determine the engaged and disengaged bending stiffness values of the portion of bag 600 is similar to the test described above with respect to bag 100. Using the same testing parameters discussed above, the maximum bending stiffness of the engaged closure 612 and the portion of front face panel 604 attached thereto is tested. Next, second closure strip 620 is detached from first closure strip 618 and the maximum bending stiffness of first closure strip 618 and the portion of front face panel 604 attached thereto is tested. All other aspects of the test are generally the same as those described above with respect to bag 100.

Because of the relatively high bending stiffness of closure 612 in the engaged position, when closure 612 is engaged and bag 600 is hanging from a display rack, the top corner regions of bag 600 will be prevented from flopping over and covering text and graphics printed on the front and/or rear face panels 604, 606. When closure 612 is in a disengaged state, the portion of bag 600 including closure 612 will have sufficient flexibility to allow a user to comfortably access contents of the bag. For example, the portion of front face panel 604 beneath perforation 611 and to which closure 612 is attached can be sufficiently flexible to droop away from rear face panel 606, allowing the user easier access to the bag contents.

While bag closures have been described as including generally hook-shaped fastener elements 128, other types of closures that provide a substantially greater stiffness (e.g., at least ten times greater stiffness) when engaged than when disengaged may be used.

Other embodiments are within the scope of the following claims.

What is claimed is:

1. A reclosable package comprising a pouch of flexible material defining an interior volume and an opening providing access to the interior volume; and a reclosable closure secured to the flexible material adjacent the opening and operable to releasably retain the opening of the pouch in a closed state after partial removal of contents from the interior volume, the closure comprising fastenable closure strips extending along at least portions of opposite sides of the opening;

wherein the closure strips are releasably fastenable in multiple relative positions spaced along each of two perpendicular directions;

wherein the closure and flexible material of the pouch are configured to provide a maximum stiffness, in resistance to bending about a pouch axis extending along the pouch perpendicular to the closure strips, as determined at a point along the closure with the closure strips fastened, that is at least 10 times the maximum stiffness, in resistance to bending about the pouch axis, of one of the closure strips as secured to the flexible material, as determined at the point along the closure with the closure strips unfastened; and wherein the closure extends from a first side edge region of the pouch to a second side edge region of the pouch along a top region of the pouch such that, when the closure strips are fastened, the closure inhibits the flexible material of the pouch adjacent the closure from becoming deformed.

2. The reclosable package of claim 1, wherein the closure strips carry compatible arrays of discrete fastening projections, the arrays featuring multiple rows and multiple columns of fastening projections that are interengageable in multiple relative positions along each row and along each column.

3. The reclosable package of claim 2, wherein each projection is in the form of a hook having a head that extends to a reentrant tip to form a crook.

4. The reclosable package of claim 3, wherein the hooks of each strip extend from a flexible, unitary base, the base and hooks of each strip forming a single, contiguous mass of resin.

5. The reclosable package of claim 3, wherein the head of each hook overhangs the base on a side opposite the tip of the head.

6. The reclosable package of claim 1, wherein the pouch defines a flexible face surface carrying graphics that overlie the closure.

7. The reclosable package of claim 1, wherein an edge region of the pouch adjacent the closure defines an aperture through the flexible material, on a side of the closure opposite the interior volume, by which aperture the pouch is supportable in a hanging position when filled, the closure stiffening an upper portion of the package when hung from the aperture.

8. The reclosable package of claim 1, wherein the pouch has a gusseted end spaced from the opening, such that the pouch is configured to be self-supporting in an upright position on the gusseted end when filled.

9. The reclosable package of claim 8, wherein the opening is disposed at an upper end region of the pouch in its upright position.

10. The reclosable package of claim 1, wherein the pouch comprises a front face panel and a rear face panel that are sealed together along the side edge regions.

11. The reclosable package of claim 1, wherein the pouch of flexible material comprises a front face panel that defines the opening, and one of the closure strips is attached to the front face panel above the opening and another of the closure strips is attached to the front face panel below the opening.

12. The reclosable package of claim 1, wherein the closure comprises a base having a thinned tear region that connects a first of the closure strips to a second of the closure strips.

13. The reclosable package of claim 12, wherein the thinned tear region is configured to be manually torn so that the first and second closure strips can be separated from one another.

14. The reclosable package of claim 1, wherein the closure and flexible material of the pouch are configured to provide a maximum stiffness, in resistance to bending about the pouch axis, as determined at a point along the closure with the closure strips fastened, that is at least 15 times the maximum stiffness, in resistance to bending about the pouch axis, of one of the closure strips as secured to the flexible material, as determined at the point along the closure with the closure strips unfastened.

15. The reclosable package of claim 14, wherein the closure and flexible material of the pouch are configured to provide a maximum stiffness, in resistance to bending about the pouch axis, as determined at a point along the closure with the closure strips fastened, that is at least 20 times the maximum stiffness, in resistance to bending about the pouch axis, of one of the closure strips as secured to the flexible material, as determined at the point along the closure with the closure strips unfastened.

16. The reclosable package of claim 1, wherein the closure and flexible material of the pouch are configured to provide a maximum stiffness, in resistance to bending about the pouch axis, as determined at a point along the closure with the closure strips fastened, that is 10-30 times the maximum stiffness, in resistance to bending about the pouch axis, of one of the closure strips as secured to the flexible material, as determined at the point along the closure with the closure strips unfastened.

17. The reclosable package of claim 1, wherein the closure and flexible material of the pouch are configured to provide a maximum stiffness, in resistance to bending about the pouch axis, as determined at a point along the closure with the closure strips fastened, that is 15-25 times the maximum stiffness, in resistance to bending about the pouch axis, of one of the closure strips as secured to the flexible material, as determined at the point along the closure with the closure strips unfastened.

* * * * *